US006520696B2

(12) United States Patent
Huss et al.

(10) Patent No.: US 6,520,696 B2
(45) Date of Patent: Feb. 18, 2003

(54) TAPE SUPPLY CARTRIDGE

(75) Inventors: James F. Huss, Scottsdale, AZ (US); David N. Fronek, Edina, MN (US)

(73) Assignee: Brother Industries, Ltd., Nagoya (JP)

( * ) Notice: Subject to any disclaimer, the term of this patent is extended or adjusted under 35 U.S.C. 154(b) by 0 days.

(21) Appl. No.: 09/860,629

(22) Filed: May 21, 2001

(65) Prior Publication Data

US 2002/0012558 A1 Jan. 31, 2002

Related U.S. Application Data

(63) Continuation of application No. 09/629,201, filed on Jul. 31, 2000, now abandoned

(60) Provisional application No. 60/147,582, filed on Aug. 6, 1999.

(51) Int. Cl.[7] ..... B41J 35/28

(52) U.S. Cl. ..... 400/208; 400/207; 400/247; 400/248

(58) Field of Search ..... 400/208, 207, 400/247, 248, 248.1, 248.2, 249; 347/214

(56) References Cited

U.S. PATENT DOCUMENTS

| | | | | |
|---|---|---|---|---|
| 4,678,353 A | * | 7/1987 | Richardson et al. | 400/248 |
| 4,815,874 A | | 3/1989 | Richardson et al. | 400/208 |
| 4,927,278 A | | 5/1990 | Kuzuya et al. | 400/208 |
| 4,966,476 A | | 10/1990 | Kuzuya et al. | 400/208 |
| 4,983,058 A | | 1/1991 | Nagae | 400/249 |
| 5,022,771 A | | 6/1991 | Paque | 400/208 |
| 5,188,469 A | | 2/1993 | Nagao et al. | 400/615.2 |
| 5,350,243 A | | 9/1994 | Ichinomiya et al. | 400/208 |
| 5,419,648 A | | 5/1995 | Nagao et al. | 400/208 |
| 5,593,241 A | * | 1/1997 | Kawaguchi | 400/613 |
| 5,636,926 A | | 6/1997 | Yamaguchi | 400/120.02 |
| 5,653,542 A | | 8/1997 | Sugimoto et al. | 400/248 |
| 5,771,803 A | | 6/1998 | Takami | 101/128.21 |
| 5,813,773 A | | 9/1998 | Kawai | 400/207 |

FOREIGN PATENT DOCUMENTS

| | | |
|---|---|---|
| JP | 10-237397 | 9/1998 |

* cited by examiner

*Primary Examiner*—John S. Hilten
*Assistant Examiner*—Minh H. Chau
(74) *Attorney, Agent, or Firm*—Oliff & Berridge, PLC

(57) ABSTRACT

A tape supply cartridge for use in a printer of the type having a fixed print head, a movable platen roller and a pair of tape advancement rollers, one in the cartridge and one in the printer.

24 Claims, 9 Drawing Sheets

TAPE SUPPLY CARTRIDGE

This is a Continuation of application Ser. No. 09/629,201 filed Jul. 31, 2000, now abandoned, which claims the benefit of provisional application No. 60/147,582 filed Aug. 6, 1999. The entire disclosure of the prior application is hereby incorporated by reference herein in its entirety.

BACKGROUND OF THE INVENTION

1. Field of the Invention

The present invention relates generally to a tape supply cartridge and more specifically to a tape supply cartridge for use in a labeler for printing indicia on such tape for selective application to a desired medium. Still more specifically, the present invention relates to a tape supply cartridge of the type commonly referred to as a non-laminated, thermal transfer tape supply cartridge.

2. Description of the Prior Art

A great number of prior art tape supply cartridges and patents exist for use in connection with label or strip printers or the like. These cartridges provide a supply of wound printing tape to a print head for printing indicia on the tape for subsequent selective application to a desired medium. Some of these cartridges are exemplified by and disclosed in U.S. Pat. Nos. 5,188,469; 5,350,243; 5,653,542; 5,813,773; 4,927,278; 4,983,058 and 5,419,648, among others. These cartridges are designed to be used in labeling machines or printers which have a cartridge receiving cavity for receiving the cartridge in an operative position, a thermal print head and an associated platen roller which is selectively moveable toward and away from the print head, with the tape positioned therebetween, for the purpose of forming an image on, or transferring an image to, the tape. Such labeling machines or printers also include a means for advancing the tape past the print head and for advancing the various other spooled components through apparatus.

Although the cartridges of the prior art function satisfactorily for their particular application, there is a continuing need for improvement of such cartridges. Particular features for which there is a continuing need for improvement include the ability of the cartridge to accommodate different sizes and widths of tape relative to a transfer ribbon, the ability of the cartridge to guide the tape through the cartridge while ensuring that proper tape resistance is achieved and the ability of the cartridge to minimize jamming of the tape at the cutting station, among others. Accordingly, there is a need for an improved tape supply cartridge for use in a tape printer as described above and a tape for use in such a cartridge.

SUMMARY OF THE INVENTION

The present invention relates to a tape supply cartridge for use in a labeling machine or other printer. More specifically, the tape supply cartridge of the present invention includes a spool of printing tape for receiving a printed image for subsequent selective application to a desired medium and a spool of transfer ribbon for transferring the image to the tape. In the preferred embodiment, the tape supply cartridge is designed for use with a labeling apparatus or other printer having a cartridge receiving cavity and a print station comprised of a fixed print head and a moveable platen roller designed for movement toward and away from the print head between a print and a non-print position, respectively. Such a printer also includes means for advancing the tape supply through the cartridge. One feature of the present invention includes an improved guide means for guiding the tape and the transfer ribbon through a guide arm and toward the print station along separate paths to avoid undesirable contact between the tape and ribbon prior to reaching the print station. Such feature is applicable to a cartridge in which the tape and ribbon are of the same width as well as a cartridge in which such widths are different.

A further feature of the present invention includes an improved means for guiding the printing tape from the printing tape spool past the print station and outwardly from the cartridge. In the preferred embodiment, this guide means includes a guide surface positioned adjacent to the tape supply spool and a pair of guide posts with guide rollers mounted thereon. A tape path barrier positioned between the rollers is also provided for preventing the tape from being inadvertently routed along an undesired path, such as a path between the rollers. Combined with this feature is a means in the form of one or more tack discs for providing resistance to rotation of the tape supply spool and a tape of specified stiffness and consistency to provide optimal movement of the tape through the cartridge.

A further feature of the present invention is to provide a tape exit end of the cartridge which is provided with a cartridge wall portion with a substantially flush outer surface and with no overhanging or protruding portion. This wall portion is further provided with an angled exit slot for guiding the printed tape toward a cut means in such a way as to prevent the tape from catching on the cutter blade and thereby jamming the printer.

A still further feature of the present invention is to provide a tape supply cartridge with a particular tape supply and density which eliminates discoloration when exposed to extreme heat conditions. More specifically, the tape supply in accordance with the present invention has coloring which is not chemically enhanced by using chemical whitening agents or the like. Instead, the tape used in the tape supply of the present invention is an acrylic tape having a specific gravity greater than about 1.2 and including titanium dioxide ($TiO_2$) as the whitening or color agent.

Accordingly, it is an object of the present invention to provide an improved tape supply cartridge for a labeling apparatus or printer.

Another object of the present invention is to provide an improved tape guide means for such a cartridge.

A still further object of the present invention is to provide an improved tape supply and guide mechanism in combination with tape parameters to ensure optimal movement of tape through the cartridge, while at the same time preventing the tape supply spool from free wheeling.

A still further object of the present invention is to provide an improved means at the tape exit end of the cartridge for limiting or eliminating jamming problems resulting from the interface between the printed tape and the tape cut mechanism.

A still further object of the present invention is to provide an improved tape supply cartridge of the non-laminated, thermal transfer type.

These and other objects of the present invention will become apparent with reference to the drawings, the description of the preferred embodiment and the appended claims.

DESCRIPTION OF THE PREFERRED EMBODIMENT

The present invention relates to a tape supply cartridge and more specifically to what is commonly referred to as a non-laminated tape supply cartridge. Tape supply cartridges of this type are designed for use in labelers or printers which include a cartridge receiving cavity, a print head 7 (FIG. 6), a platen roller 8 moveable toward and away from the print head 7 to define printing and nonprinting positions, a means for advancing the tape and ribbon through the cartridge and past the print station and a means for selectively cutting the tape after printing.

Figure 1:
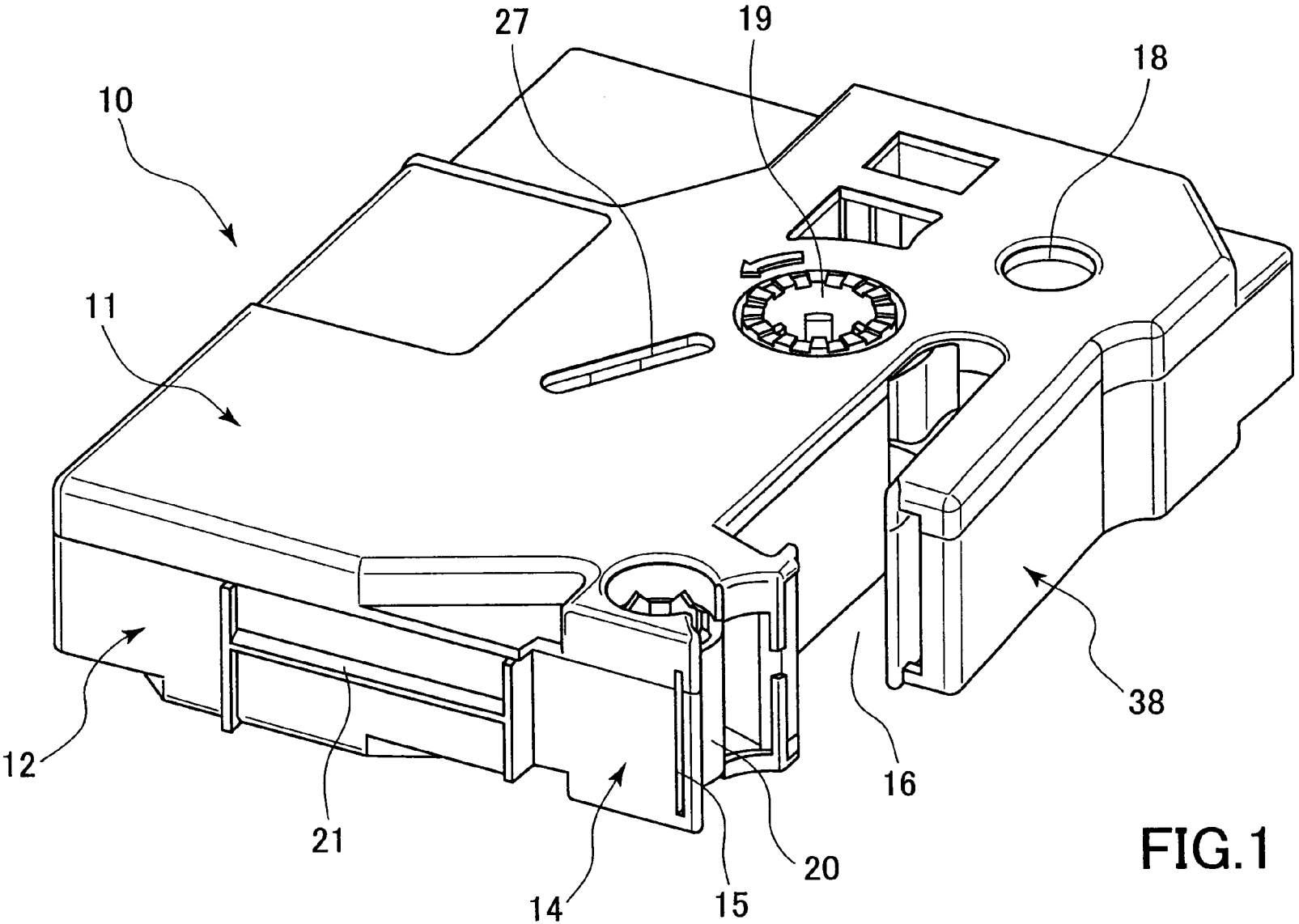
FIG. 1 is an isometric view of the tape supply cartridge in accordance with the present invention.
Figure 2:
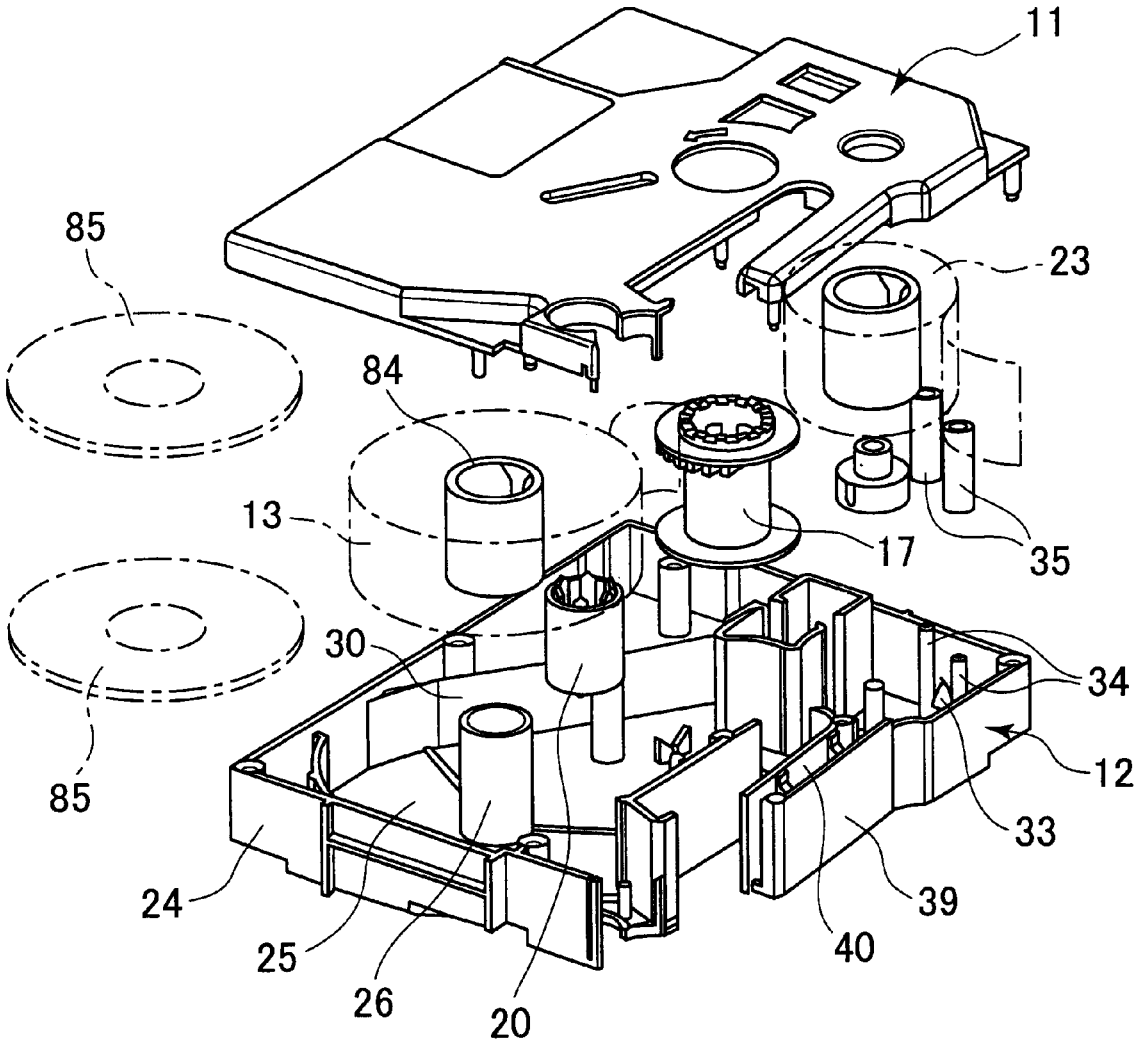
FIG. 2 is an isometric, exploded view of the tape supply cartridge of the present invention.

In describing the preferred embodiment of the present invention, reference is first made to FIGS. 1 and 2 showing the cartridge in its fully assembled form and in an exploded form. In general, the cartridge 10 includes a cartridge top 11 and a cartridge bottom 12. When assembled, the top 11 and bottom 12 are secured together to form the cartridge 10 which house the tape supply 13, a ribbon supply spool 23 and a ribbon take-up spool 17. The cartridge also includes a tape exit end 14, a tape exit slot 15 provided at the exit end 14 and a print head cavity or recessed area 16 to accommodate a print head when the cartridge is inserted into the printer. The print head cavity is defined on one side by a tape/ribbon guide arm 38 for guiding the tape and ribbon to the print station. The areas 18 and 19 in the cartridge top 11 and bottom 12 define areas to accommodate the ink ribbon supply spool 23 and the ink ribbon take-up spool 17, respectively. A tape advance roller 20 is provided at the tape exit end of the cartridge. In the preferred embodiment, the roller 20 is a driven feed roller having internal splines, ribs or other means for mating with a drive shaft of the printer.

A latching rib 21 is provided on one side of the cartridge for engagement by a latch member (not shown) on the printer to secure the cartridge within the printer when the cartridge is inserted into the cartridge cavity. A second latching rib 22 (FIG. 3) is provided on the opposite side of the cartridge bottom 12 for engagement with a second printer latch member (not shown).

Figure 3:
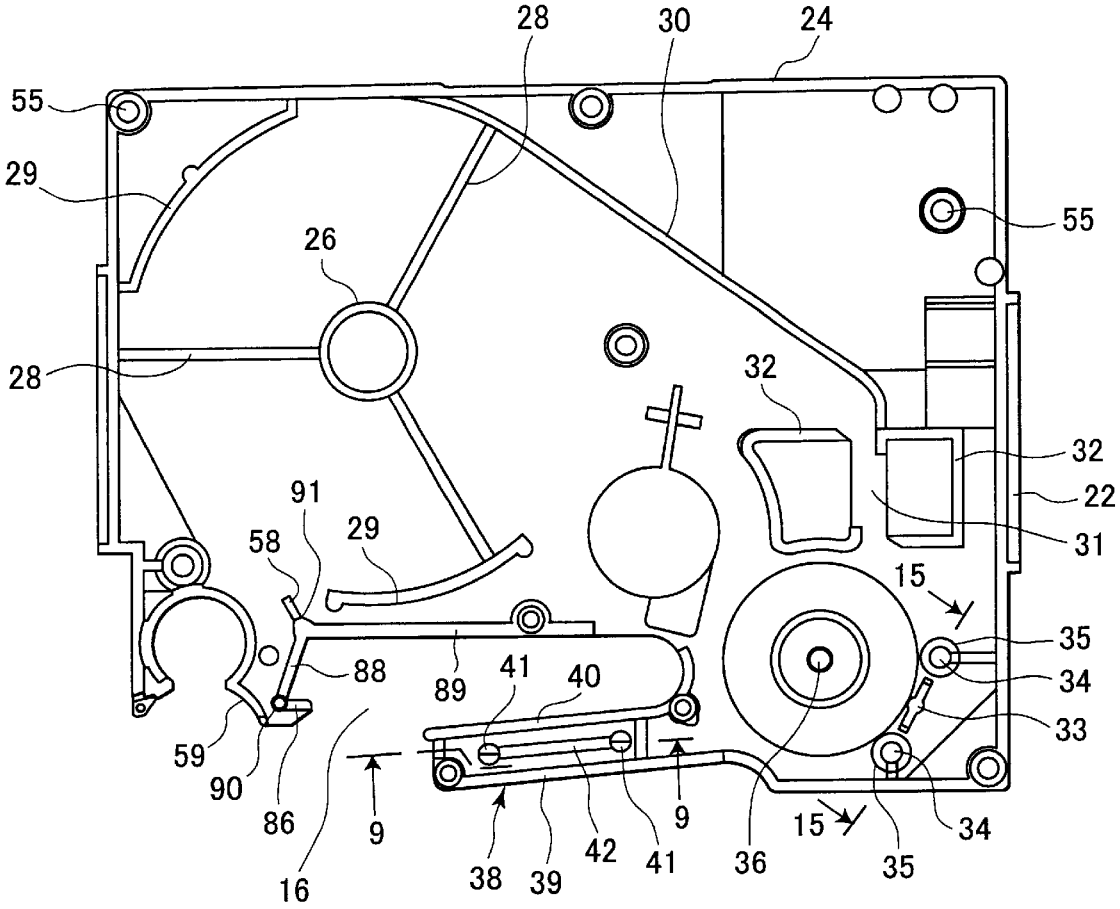
FIG. 3 is an elevational plan view of the inside of the cartridge bottom with the tape supply spool, the ribbon supply and rewind spools and various other components removed.

The interior of the cartridge bottom 12 is illustrated best with reference to FIGS. 2 and 3. As shown, the cartridge bottom 12 includes a bottom wall 25 and a side wall 24 extending upwardly from the bottom wall 25 at substantially right angles and extending around a substantial portion of the cartridge. Integrally formed with the bottom wall 25 is a tape supply hub 26 and a plurality of tape support ribs 28 extending radially outwardly from the hub 26. The hub 26 is a generally cylindrical structure which extends outwardly from the bottom wall 25 at substantially right angles and functions to rotatably support the hub 84 of the ribbon supply spool 13. A pair of tape containment wall sections 29,29 are provided to contain the tape supply spool 13 in a generally circular configuration. An elongated tape guide wall 30 extends from an inner portion of the side wall 24 to a tape passage slot 31 between the pair of spaced wall sections 32,32. The guide wall 30 extends upwardly from the bottom wall 25 at substantially right angles and ensures that the tape from the tape supply 13 is properly and accurately guided from the tape spool 13 to the tape passage 31.

A pair of tape guide/posts 34,34 are integrally formed with the bottom wall 25 and extend upwardly therefrom at right angles. The tape guide/posts 34,34 support corresponding rollers 35,35 for guiding the tape around the ribbon supply spool 23 which is rotatably mounted on the support post 36. In the preferred embodiment, the rollers 35,35 have a generally cylindrical configuration and a cylindrical interior opening slightly greater than the exterior dimension of the posts 34,34. This enables the tape to be freely pulled and advanced around the posts 34,34 by the tape advancement means. In the preferred embodiment, a barrier member 33 is positioned between the rollers 35,35 to prevent the tape from being inadvertently or intentionally routed between the rollers 35,35. Thus, the member 33 forces the tape to have only a single pathway around the outside of the rollers 35,35. Preferably, as shown best in FIG. 15, the barrier is provided with a generally trapezoidal cross-sectional configuration.

The portion of the cartridge bottom 12 defining the tape/ribbon guide arm 38 includes an outer side wall 39 and an inner side wall 40 which are substantially parallel to one another. Each of the walls 39 and 40 are of approximately equal height measured from the bottom wall 25 and are taller than the major portion of the side wall 24 extending around the periphery of the cartridge bottom. Positioned approximately midway between the walls 39 and 40 is a tape/ribbon separation wall or barrier defined by a pair of posts 41, 41 and a wall section 42 integrally joined with the posts 41, 41 and extending therebetween. As shown best in FIG. 10, posts 41, 41 are taller than the wall sections 39 and 40 and the wall section 42 is significantly shorter than either the posts 41, 41 or the walls 39, 40. The upper ends of the posts 41, 41 are provided with a recessed portion 44 which is designed to accommodate an upper tape guide member 45 integrally formed with a corresponding portion of the cartridge top 11 defining the tape/ribbon guide arm 38. This portion of the cartridge top 11 includes a pair of short wall sections 46 and 47 designed to mate with the wall sections 39 and 40 when the cartridge is assembled.

The bottom wall 25, in the area of the tape/ribbon guide arm 38 is provided with a pair of bottom tape/ribbon guide edges 48 and 49, respectively for guiding the lower edges of the tape and the ribbon at the same height through the guide arm 38. In contrast, the ribbon side of the barrier between the wall section 42 and the wall 40 is provided with a pair of guide edges for guiding the top edge of the ribbon only. The tape side of the barrier between the wall section 42 and the wall 39 is provided with a pair of spaced tape guide members 45 for guiding the top edge of the tape only.

Figure 10:
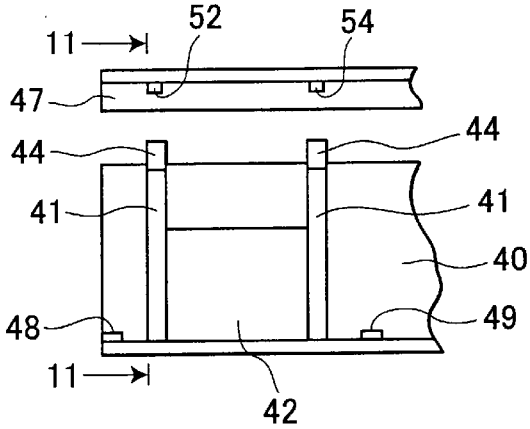
FIG. 10 is a view, partially in section, as viewed along the section line 10—10 of FIG. 3.
Figure 11A:
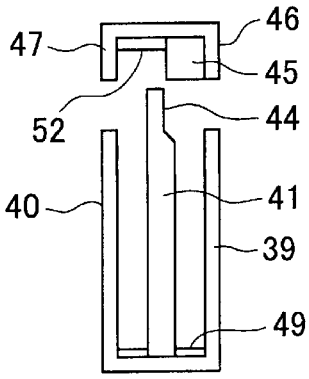
FIG. 11*a* is a view, partially in section, as viewed along the section line 11—11 of FIG. 10.
Figure 11B:
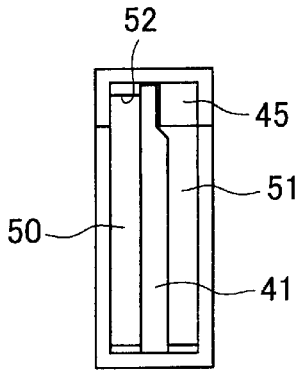
FIG. 11*b* is a view similar to that of FIG. 11*a*, but with the cartridge top and bottom in assembled form.

When the cartridge top 11 and bottom 12 are assembled as shown in FIG. 11*b*, the tape/ribbon guide arm 38 defines a guide passage 50 for the ribbon and a guide passage 51 for the tape. As shown, this particular embodiment illustrated in FIGS. 10, 11*a* and 11*b* is designed for a cartridge in which the ribbon is wider than the tape and in which the bottom edges of the tape and the ribbon are guided by a common guide edge at the same level. In the embodiment of FIGS. 11*a* and 11*b*, the tape guide edges 49 guide the bottom edges of both the tape and ribbon, while the guide edge 52 guides the top edge of the ribbon and the guide member 45 guides the top edge of the tape.

Figure 12:
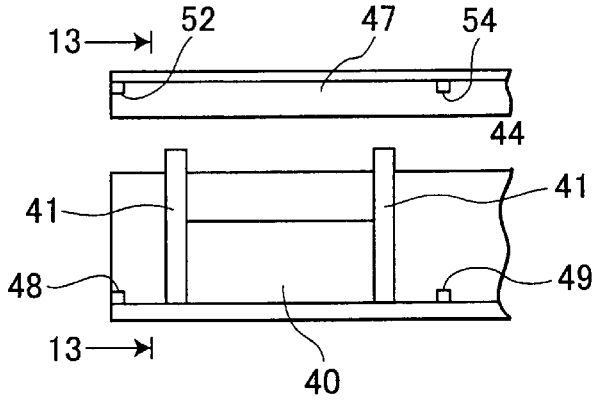
FIG. 12 is a view, partially in section, similar to that of FIG. 10 of an alternate embodiment.
Figure 13A:
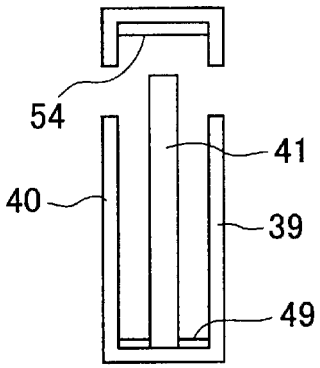
FIG. 13*a* is a view, partially in section, as viewed along the section line 13—13 of FIG. 12.
Figure 13B:
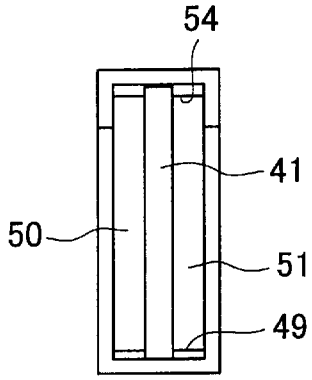
FIG. 13*b* is a view similar to that of FIG. 13*a*, but with the cartridge top and bottom in assembled form.

An alternate embodiment for the tape arm is illustrated in FIGS. 12, 13*a* and 13*b*. The embodiment of FIGS. 12, 13*a* and 13*b* is similar to that of FIGS. 10, 11*a* and 11*b* except that it is designed for a supply cartridge in which the tape and the ribbon are of equal width. When assembled as shown in FIG. 13*b*, this embodiment of the tape/ribbon guide arm defines a ribbon passageway 50 and tape passageway 51 which are of equal height dimensions. As shown, when the tape/ribbon guide arm 38 is assembled, the arm 38 defines a ribbon passageway 50 and a tape passageway 51 of the same height. In this embodiment, both passageways 50 and 51 are defined on their bottoms by the guide edge 49 and on their tops by the guide edge 52.

The cartridge bottom further includes a plurality of connection holes 55 positioned throughout the cartridge bottom for mating with corresponding connection posts 56 from the cartridge top to retain the cartridge top 11 and bottom 12 together when the cartridge is assembled.

Figure 6:
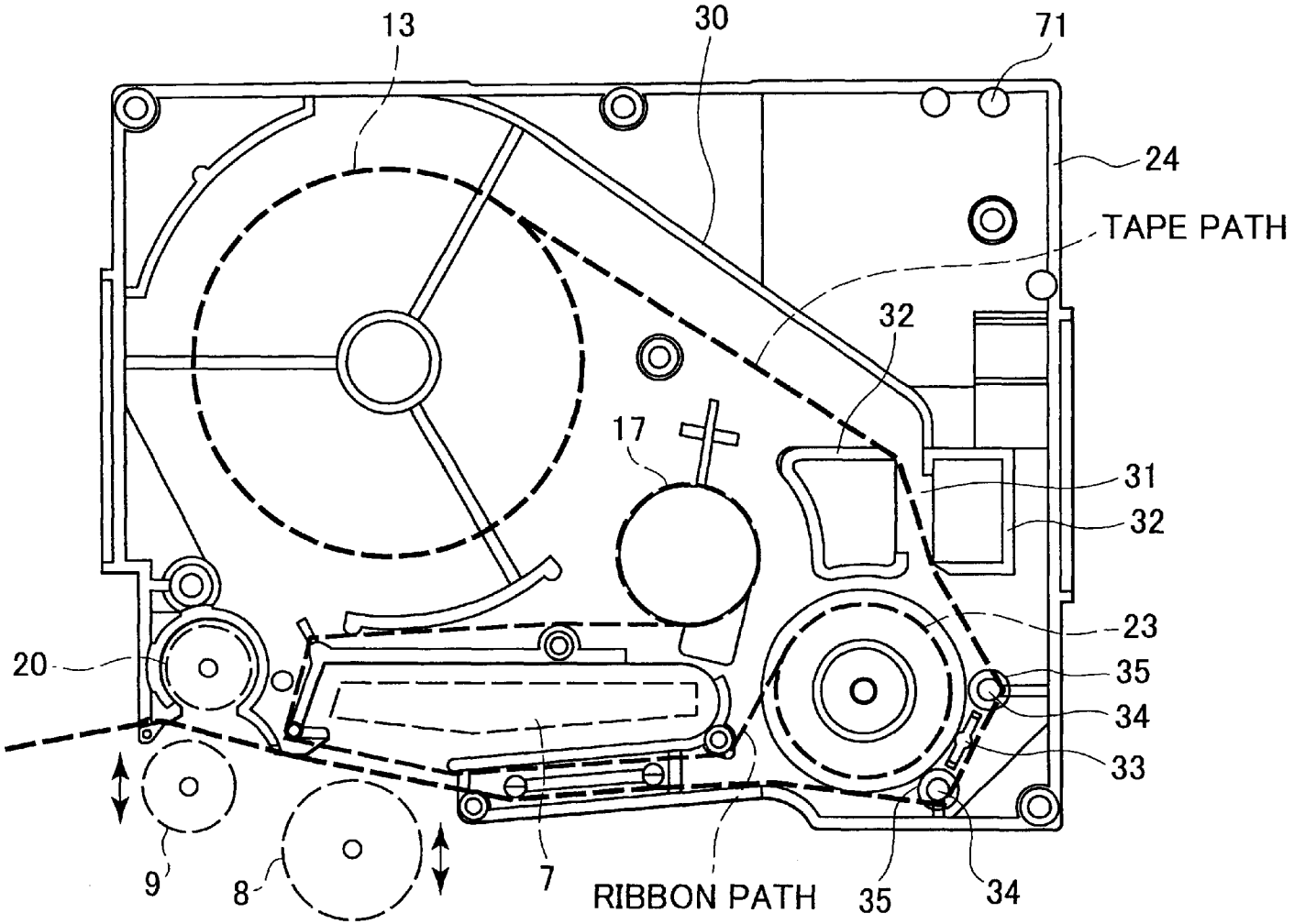
FIG. 6 is an elevational view of the inside of the cartridge bottom, similar to FIG. 3, showing the tape and ribbon pathways.

After the tape and ribbon leave the guide arm 38, they pass the print station as shown in FIG. 6. From there, the ribbon is guided around the walls defining the print head recess 16 and the tape is guided past the tape advancement or feed roller 20. In the preferred embodiment, the guide ribs 58 and 59 are not only at the same level, but are also at the same level as the guide edges 48 and 49 in the guide arm 38.

The print head recessed area 16 as shown best in FIGS. 1–6 is defined on one side by the inner wall sections 40 and 68 of the cartridge bottom and tops and on the opposite sides by the wall sections 86, 88 and 89. The walls sections 86, 88 and 89 are integrally formed with the bottom wall 25 and extend upwardly therefrom at substantially right angles. The wall sections 86, 88 and 89 are joined to one another at their side edges and form a generally continuous wall which, together with the wall section 40, defines the cavity 16. The ends of the wall sections 86 40 are spaced from one another as shown to provide an opening through which the platen roller 8 (FIG. 6) may move relative to the print head 7 to define the print station. The wall sections 86, 88 and 89 together form a guide for the ribbon following the printing operation at the print station. As shown, the juncture between the wall sections 86 and 88 and between the wall sections 88 and 89 are provided with rounded edges 90 and 91 to provide a smooth, low friction surface for advancement of the ribbon to the ribbon rewind spool 17.

Figure 4:
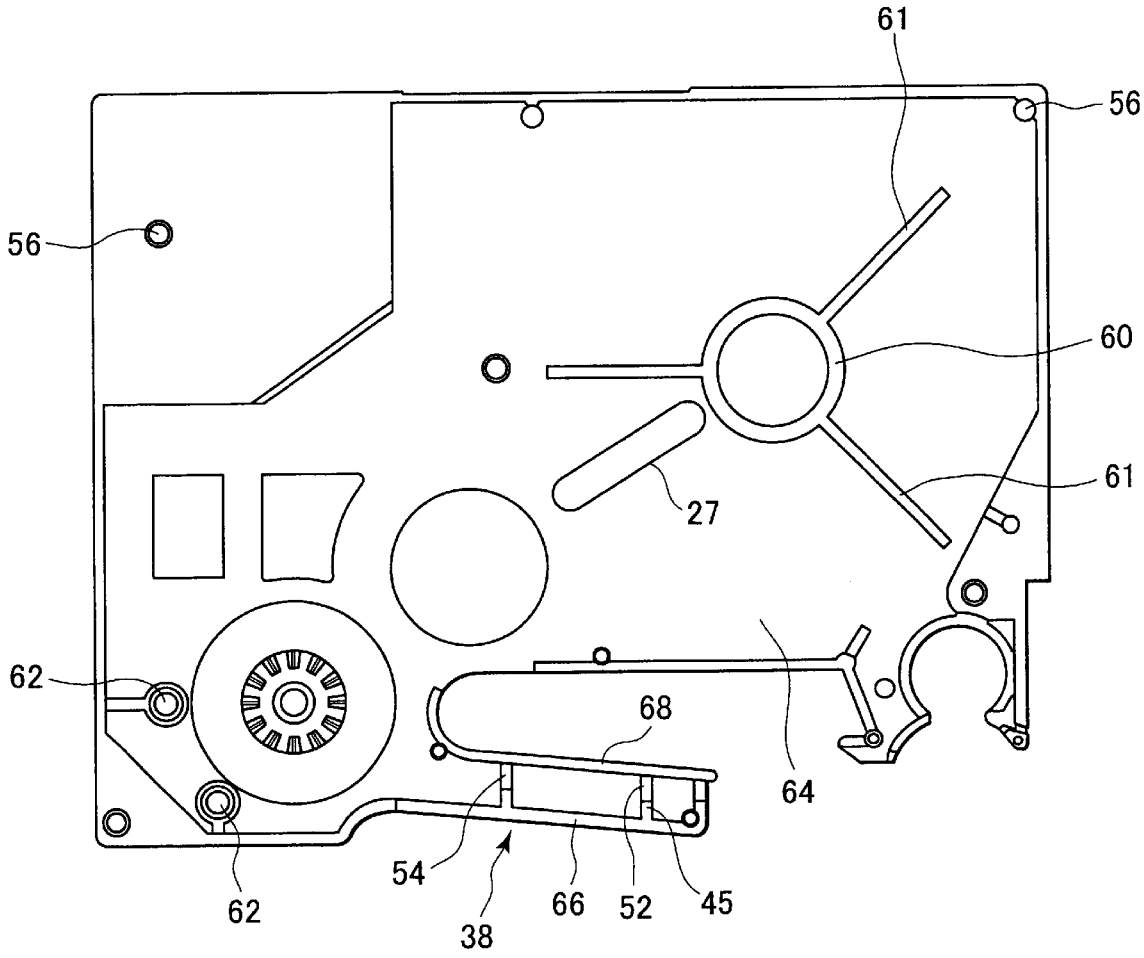
FIG. 4 is an elevational plan view of the inside of the cartridge top.

The cartridge top 11 as shown in FIG. 4, includes a top wall 64 and a side wall 65 extending around a substantial portion of the periphery of the cartridge top 11. A portion of the cartridge top corresponds to the tape/ribbon guide arm 38. This portion includes an outer edge 66 and an inner edge 68 substantially parallel to one another and corresponding to the edges 39 and 40, respectively, of the cartridge bottom 12. In the preferred embodiment, the wall portions 66 and 68 are shorter than the remainder of the side wall 65.

Figure 15:
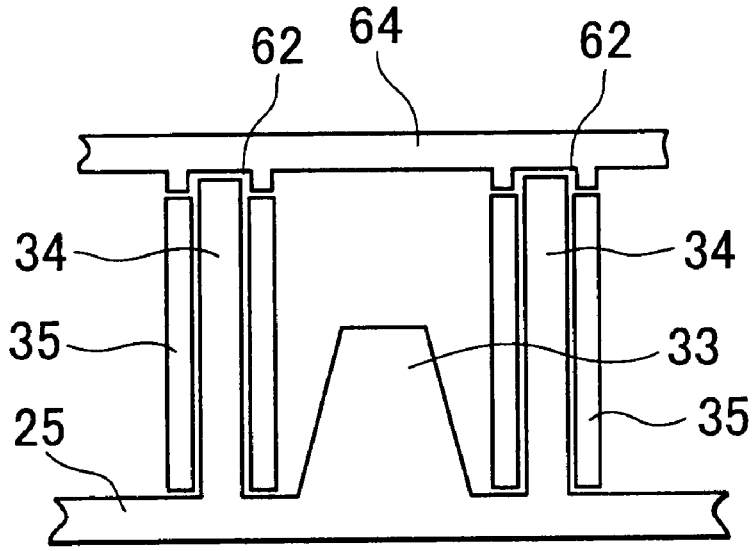
FIG. 15 is a view, partially in section, as viewed along the section line 15—15 of FIG. 3.

The inside of the cartridge top 11 comprises elements corresponding to various elements in the cartridge bottom 12 including a plurality of connection posts 56 positioned throughout the top wall 64. These connection posts 56 are designed for insertion into the corresponding connection holes 55 in the cartridge bottom to fix the top 11 to the bottom 12. The cartridge top also includes a generally circular rib 60 and a plurality of ribs 61 extending radially outwardly from the rib 60. The circular rib 60 is aligned with the hub 26 (FIG. 3) and has an internal circular dimension approximating the outer circular dimension of the hub 26 so that when the cartridge is assembled, the upper edge of the hub 26 seats within the circular rib 60. The ribs 61, like the ribs 28 in the cartridge bottom, function to support the spool of tape 13 in a vertical direction relative to the cartridge top and bottom. The cartridge top 11 also includes a pair of post receiving holes 62, 62 having an interior circular dimension designed to receive the upper ends of the guide posts 34, 34 as shown in FIG. 15.

Figure 5:
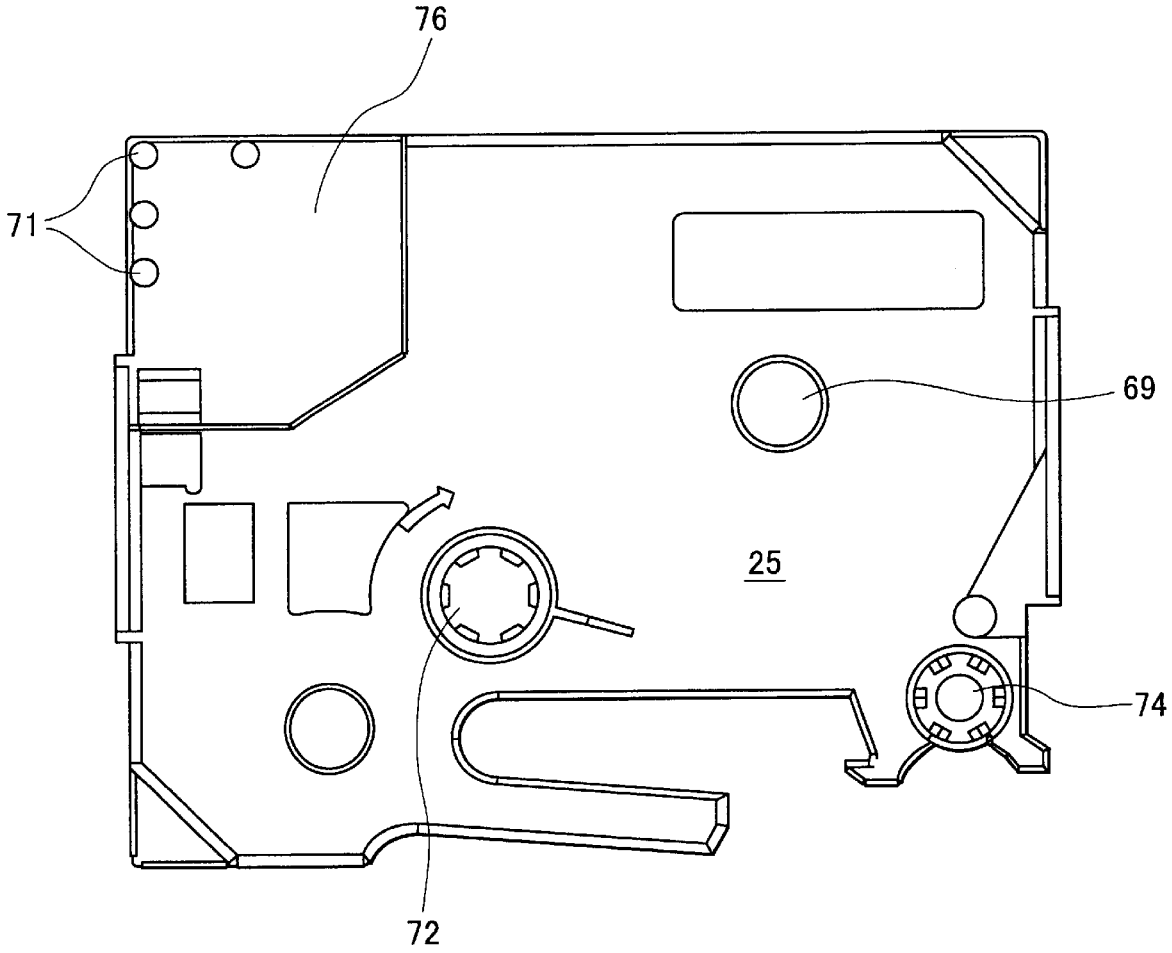
FIG. 5 is a elevational bottom view of the assembled cartridge.

The bottom side of the cartridge, as illustrated best in FIG. 5, includes an opening 69 aligned with the internal hub 26 and a recessed area 70 in a comer of the cartridge bottom to accommodate a plurality of cartridge detecting holes 71. The holes 71 are aligned with one or more plunger switches associated with the printer for the purpose of providing the printer with information regarding the characteristics of the tape within the cartridge such as tape width, whether it is laminated or non-laminated, etc. The cartridge bottom also includes an opening 72 through which a ribbon rewind shaft from the printer extends to interface with and rotate the ribbon rewind spool 17. A tape advance opening 74 is provided near the tape exit end of the cartridge and is designed to provide an interface between a tape advancement shaft in the printer and the tape advancement spool 20.

Figure 7:
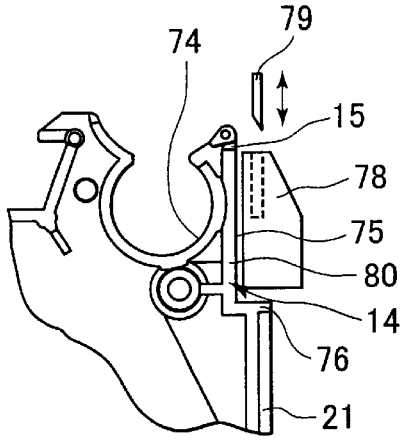
FIG. 7 is a fragmentary view, partially in section, showing the tape exit end of the cartridge in combination with a tape cutting means.
Figure 8:
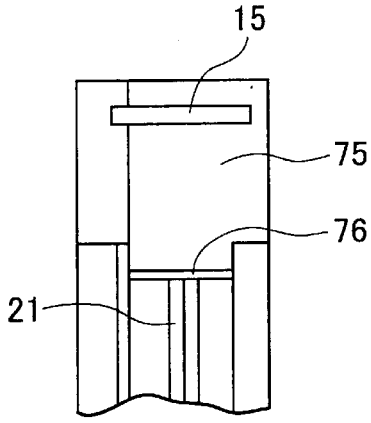
FIG. 8 is an elevational, front fragmentary view of the tape exit end of the cartridge.

As illustrated best in FIGS. 7 and 8, the tape exit end 14 includes a generally planar surface 75, the shoulder portion 76 and the tape exit slot or opening 15. Preferably, the planar surface 75 extends from the shoulder 76, past the slot 15 and to the uppermost end of the cartridge. In the preferred embodiment, the substantially planar surface 75 and the shoulder 76 form a recessed area to accommodate one embodiment of a stationary tape cutoff member 78 of the printer. As shown, the member 78 extends inwardly from an outer surface portion of the cartridge side wall and latching rib. Associated with the cutoff member 78 is a second cutoff member 79 which is designed for movement toward and away the member 78 as shown. In the embodiment of FIG. 7, the cutoff means is a scissors mechanism in which the member 78 houses one half of the scissors, while the member 79 comprises the other half of the scissors. To assist in preventing the tape from getting hung up or caught on the cutting member 79 during the cutting operation, the tape exit slot 15 is angled upwardly in the direction of tape travel through the wall section 80. Preferably the magnitude of the angle at which the slot 15 is sloped is greater than about 5° and more preferably between about 5° and 60°.

Figure 9:
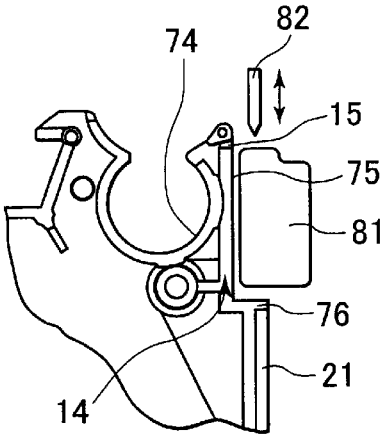
FIG. 9 is a view similar to that of FIG. 6 in combination with a second embodiment of a tape cutting means.

Although the requirement of a sloped outlet slot 15 is less of a requirement with a scissors cutoff mechanism such as that shown in FIG. 7, it is particularly desirable when used with a cutoff mechanism such as that illustrated in FIG. 9 which is a blunt cut mechanism. Specifically, this mechanism comprises the stationary backing member 81 and the knife member 82. In this type of cutting mechanism, the knife member 82 is moveable into cutting engagement with the backing member 81 along an arc relative to a pivot point. The angled slot 15 when used with this type of cutoff mechanism enables the knife section 82 to move away from the backing member 81 without carrying the tape along with it. Without the sloping or angled exit opening 15, the tendency of the cutting knife 82 to catch on the end of the tape, and thus jam the printer, is significantly increased.

Figure 14:
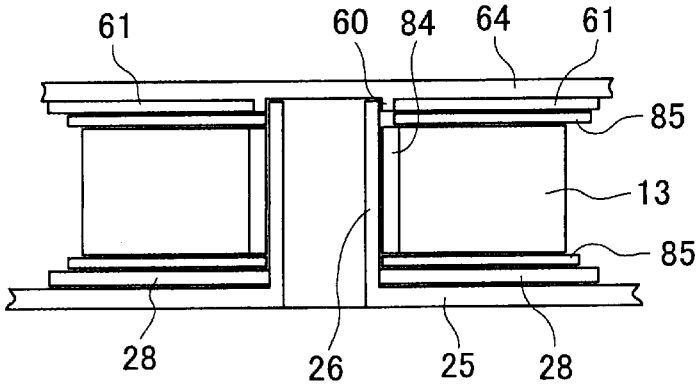
FIG. 14 is a view, partially in section, of a portion of the tape supply cartridge showing the tape supply mounted between the cartridge halves.

As shown best in FIGS. 2 and 14, the tape spool 13 includes a central support hub 84 which is designed to fit over the hub 26. When the spool of tape 13 is assembled within the cartridge, a tack disk 85 is positioned on each side of the tape spool 13. The tack disk includes one surface (the inner surface) which is tacky or includes a light adhesive and an opposite surface (the outer surface) which is relatively smooth and friction free. The tack disks 85,85 perform two primary functions. First, they prevent the spool of tape 13 from free wheeling or unwinding when the cartridge is not in use and is being handled. Without the disks 85,85, any movement of the cartridge could cause the spool of tape 13 to unwind. Secondly, the tack disks 85,85 provide a controlled amount of drag on the tape spool 13. This drag, in combination with the specific type and stiffness of the tape and the amount of force needed to advance or pull the tape around the rollers 35,35 must be such as to ensure that the tape is properly advanced through the cartridge. Specifically, the tape should have sufficient drag as it travels through the cartridge and past the print head so that it will not freewheel or sag. On the other hand, the drag must be sufficiently small so that the tape advancement mechanism positively advances the tape through the system. Further, this controlled drag must be consistent both at the start of the spool 13 and at the end of the spool 13. Still further, the tape should be stiff enough to prevent it from catching on the tape cutoff mechanism and jamming the printer.

Figure 16:
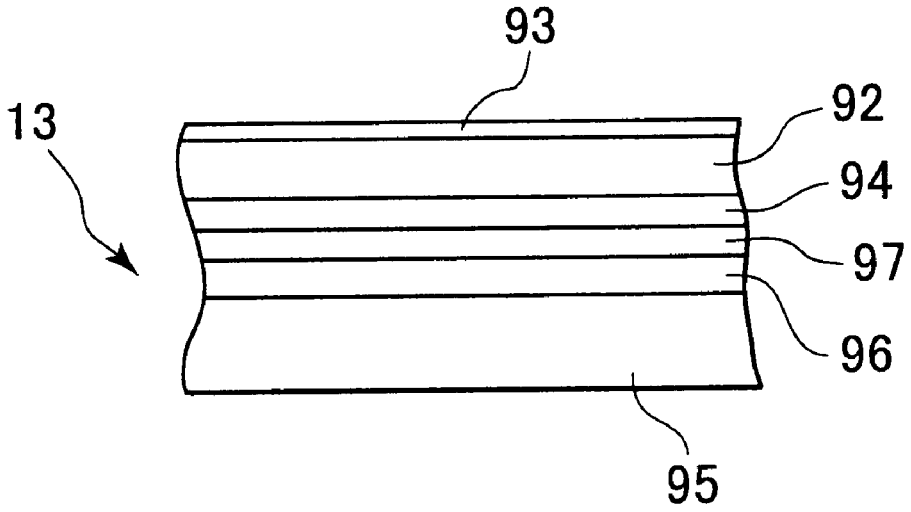
FIG. 16 is a cross-sectional view showing the tape structure.

The tape 13 to be used in the cartridge of the present invention is intended to be a so-called non-laminated tape which includes a print receiving tape layer and a release layer. Specifically, as shown best in FIG. 16, the print receiving tape layer comprises the base film 92 and the coating 93 applied thereto. In the preferred embodiment, the base film 92 is a polyethylene-terephthalate (PET) film. Preferably, the base film 92 is provided with an inert filler such as titanium dioxide ($TiO_2$) to provide the film with a white color. Because of the presence of this $TiO_2$, the specific gravity of the film 92 is preferably greater than about 1.1, more preferably greater than about 1.2 and most preferably greater than about 1.3. The presence of an inert filler such as $TiO_2$ is preferable to the chemical whiteners used in prior art films because the inert fillers provide for dimensional stability and preclude discoloration upon heating. Preferably the film 92 is about 2 mils (0.002 inches) thick. A film of this type preferably used to make the tape 13 of the present invention is a PET film manufactured by Dupont.

A heat activatable polyester resin coating 93 is applied to the print receiving surface of the film 92. This polyester resin coating 93 is a relatively thin layer and functions primarily to receive the printed image from the transfer tape. Accordingly, the chemistry of the coating 92 must be compatible with that of the transfer ribbon. Further, it is preferable for both the coating 93 and the base film 92 to be compatible (i.e., both are polyesters).

An adhesive layer 94 is applied to the opposite surface of the film 92. Preferably, the adhesive is a premium, self cross linking acrylic adhesive which is resistant to UV radiation as well as a variety of chemicals and petroleum distillates.

The second portion of the tape 13 is the release liner which is comprised of the paper base 95, an intermediate coating 96 and an outer release coating 97. In the preferred embodiment, the paper layer 95 is a densified Kraft paper, the coating 96 is a coating of polyethylene and the coating 97 is a coating of silicon.

In the preferred embodiment, the entire thickness of the tape 13 is approximately 7 mils (0.007 inches), with the print receiving tape portion (comprised of the film 92 and the layers 93 and 94) being thinner than the release liner portion (comprised of the paper layer 95 and the coatings 96 and 97).

The ribbon which is provided on the ribbon supply spool 23 is what is referred to as a thermal transfer or heat activatable ribbon. In other words, the ribbon is effective to transfer an image from the ribbon to the print receiving surface of the tape. It is preferred that the tape and the ribbon in the cartridge of the present invention be compatible with one another.

It is also important for the cartridge of the present invention that the tape have sufficient stiffness so that when it exits the exit slot 15 and is cut by the cutting mechanism, it is stiff enough to resist moving along with the retraction of the moveable cutting member. In the preferred embodiment, such stiffness is provided by the thickness of the paper base layer 95 which, together with the coatings 96 and 97, is thicker than the print receiving portion of the tape.

When the cartridge is fully assembled, the tape extends from the tape spool 13 along the tape path as shown in FIG. 6. Specifically, the tape extends from the spool 13 where it is guided by the guide wall 30 through the pathway 31 between the elements 32,32. From there, the tape extends around the guide rollers 35,35 and through the pathway 51 in the guide arm 38 between the posts 41,41 and the wall section 39. From there, it extends to and across the printing region between the print head 7 and the platen roller 8, past the advancement area between the roller 20 and the drive roller 9 of the printer and then outwardly through the exit slot 15. The ribbon extends from the ribbon supply spool 23, through the pathway 50 between the posts 41,41 and the wall section 40, past the printing region between the print head 7 and the platen roller 8 and then around the wall sections 86, 88 and 89 to the ribbon take up spool 17.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A tape supply cartridge for a printer of the type having a cartridge receiving cavity, a fixed print head defining a print station, a platen roller movable toward and away from said print head between a print and non print position and a pair of rollers for advancing the tape between the platen roller and print head, said cartridge comprising:

a cartridge top, a cartridge bottom and a cartridge edge wall joining said cartridge top and bottom and extending substantially around said cartridge;

a supply of printing tape housed in said cartridge on a tape supply spool between said cartridge top and said cartridge bottom;

a supply of ribbon;

a guide arm having adjacent channels, each channel having upper and lower edge guides, respectively, fixed to an inner surface of the cartridge top and an inner surface of the cartridge bottom for guiding one of the ribbon and tape toward the print station;

a pair of tape guide posts positioned between said tape supply spool and said guide arm extending between said cartridge top and said cartridge bottom; and a roller rotatably mounted on each of said tape guide posts wherein said tape moves from said tape supply spool, around said rollers and to said guide arm during movement through said cartridge.

2. The tape supply cartridge of claim 1 including a tack disc on each side of said tape supply spool.

3. The tape supply cartridge of claim 1 including a barrier between said tape guide posts to prevent said tape from being routed along an undesired path.

4. The tape supply cartridge according to claim 1, further comprising a guide wall extending between a point on the cartridge edge wall proximate the tape supply spool to a point before a first tape guide post of the pair of tape guide posts.

5. The tape supply cartridge according to claim 1, further comprising at least one tack disk opposing a side of the supply of printing tape on the tape supply spool, a side of the tack disk opposing the supply of printing tape being one of tacky and having a coating of light adhesive.

6. The tape supply cartridge according to claim 1, further comprising a pair of opposing wall sections, defining a tape passage slot therebetween, the pair of wall sections near to a tape guide post/roller combination, wherein the tape is feed from the tape supply spool through the tape passage slot and around the pair of tape guide posts, each tape guide post having the rollers mounted thereon, to the print station.

7. A tape supply cartridge for a printer of the type having a cartridge receiving cavity, a fixed print head defining a print station, a platen roller movable toward and away from said print head between a print and non print position and a pair of rollers, for advancing the tape between the platen roller and print head, said cartridge comprising:

a cartridge top, a cartridge bottom and a cartridge edge wall joining said cartridge top and bottom and extending substantially around said cartridge;

a supply of printing tape housed in said cartridge on a tape supply spool between said cartridge top and said cartridge bottom;

a supply of ribbon;

a guide arm having adjacent channels, each channel having upper and lower edge guides, respectively, fixed to an inner surface of the cartridge top and an inner surface of the cartridge bottom for guiding one of the ribbon and tape toward the print station;

a pair of tape guide posts positioned between said tape supply spool and said guide arm extending between said cartridge top and said cartridge bottom; and a barrier between said tape guide posts to prevent said tape from being routed along an undesired path.

8. The tape supply cartridge according to claim 7, further comprising a guide wall extending between a point on the cartridge edge wall proximate the tape supply spool to a point before a first tape guide post of the pair of tape guide posts.

9. The tape supply cartridge according to claim 7, further comprising at least one tack disk opposing a side of the supply of printing tape on the tape supply spool, a side of the tack disk opposing the supply of printing tape being one of tacky and having a coating of light adhesive.

10. The tape supply cartridge according to claim 7, further comprising a pair of opposing wall sections, defining a tape passage slot therebetween, the pair of wall sections near to a tape guide post/roller combination, wherein the tape is feed from the tape supply spool through the tape passage slot, and around the pair of tape guide posts, each tape guide post having the roller mounted thereon, to the print station.

11. A tape supply cartridge for a printer of the type having a cartridge receiving cavity, a fixed print head defining a print station, a platen roller movable toward and away from said print head between a print and non print position and a pair of rollers for advancing the tape between the platen roller and print head, said cartridge comprising:

a cartridge top, a cartridge bottom and a cartridge edge wall joining said cartridge top and bottom and extending substantially around said cartridge;

a supply of printing tape housed in said cartridge on a tape supply spool between said cartridge top and said cartridge bottom;

a supply of ribbon;

a guide arm having adjacent channels, each channel having upper and lower edge guides, respectively, fixed to an inner surface of the cartridge top and an inner surface of the cartridge bottom for guiding one of the ribbon and tape toward the print station;

a pair of tape guide posts positioned between said tape supply spool and said guide arm extending between said cartridge top and said cartridge bottom;

a roller rotatably mounted on each of said tape guide posts wherein said tape moves from said tape supply spool, around said rollers and to said guide arm during movement through said cartridge; and a barrier between said tape guide posts to prevent said tape from being routed along an undesired path;

said tape supply comprising a PET base layer provided with a filler of $TiO_2$, a top coating of heat activatable material and a bottom release layer.

12. The tape supply cartridge according to claim 11, further comprising a guide wall extending between a point on the cartridge edge wall proximate the tape supply spool to a point before a first tape guide post of the pair of tape guide posts.

13. The tape supply cartridge according to claim 11, further comprising at least one tack disk opposing a side of the supply of printing tape on the tape supply spool, a side of the tack disk opposing the supply of printing tape being one of tacky and having a coating of light adhesive.

14. The tape supply cartridge according to claim 11, further comprising a pair of opposing wall sections, defining a tape passage slot therebetween, the pair of wall sections near to a tape guide post/roller combination, wherein the tape is feed from the tape supply spool through the tape passage slot, and around the pair of tape guide posts, each tape guide post having the roller mounted thereon, to the print station.

15. A tape supply cartridge for use with a printer having a cartridge receiving cavity, a print station having a print head, a platen roller, and advancement means for advancing a tape between the platen roller and the print head, the cartridge comprising:

a cartridge top, a cartridge bottom and a cartridge side wall between the cartridge top and the cartridge bottom and extending substantially around a cartridge perimeter;

a tape supply spool mounted in the cartridge and holding a supply of the tape;

a supply of ribbon;

a tack disk mounted between at least one of the cartridge top and the tape supply spool and the cartridge bottom and the tape supply spool;

a pair of opposing wall sections, defining a tape passage therebetween;

at least one tape guide post; and a guide arm having adjacent channels, each channel having upper and lower edge guides, respectively, fixed to an inner surface of the cartridge top and an inner surface of the cartridge bottom for guiding one of the ribbon and tape toward the print station, wherein the tape from the tape supply spool passes through the tape passage, around the at least one tape guide post to be guided to the print station by the guide arm.

16. The tape supply cartridge according to claim 15, further comprising a roller mounted on the at least one guide post.

17. The tape supply cartridge according to claim 15, further comprising a guide wall extending between a point proximate the tape supply spool to a point before the pair of opposing wall sections to guide the tape to the tape passage.

18. The tape supply cartridge according to claim 15, wherein the tack disk has a tacky surface toward an edge of the tape wound on the tape supply spool.

19. The tape supply cartridge according to claim 18, wherein there is a tack disk on each side of the tape supply spool.

20. The tape supply cartridge according to claim 15, further comprising a barrier adjacent the at least one guide post.

21. The tape supply cartridge according to claim 15, wherein the tape has a PET base layer provided with a filler of $TiO_2$, a top coating of a heat activatable material, and a bottom release layer.

22. A tape supply cartridge for use with a printer having a cartridge receiving cavity, a print station having a print head, a platen roller, and advancement means for advancing a tape between the platen roller and the print head, the cartridge comprising:

a cartridge top, a cartridge bottom and a cartridge side wall between the cartridge top and the cartridge bottom and extending substantially around a cartridge perimeter;

a tape supply spool mounted in the cartridge and holding a supply of the tape;

a pair of opposing wall sections, defining a tape passage therebetween;

at least one tape guide post;

a roller mounted on the at least one guide post;

a guide wall extending between a point proximate to the tape supply spool to a point adjacent to the pair of opposing wall sections to guide the tape to the tape passage; and a guide arm for guiding the tape toward the print station, wherein the tape from the tape supply spool passes through the tape passage, around the at least one tape guide post to be guided to the print station by the guide arm and the tape supply spool is mounted at a first corner of the cartridge located diagonally to a second corner of the cartridge located at an area of the pair of the opposing wall sections and the guide arm.

23. The tape supply cartridge according to claim 22, further comprising a tack disk mounted between at least one of the cartridge top and the tape supply spool and the cartridge bottom and the tape supply spool wherein the tack disk has a tacky surface toward an edge of the tape wound on the tape supply spool.

24. The tape supply cartridge according to claim 23, wherein the at least one tape guide post includes a pair of tape guide posts with a roller rotatably mounted on each of the tape guide posts and a barrier between the tape guide posts to prevent the tape from being routed along an undesired path with the pair of opposing wall sections located near to a tape guide post/roller combination and the tape is fed from the tape supply spool through the tape passage and around the pair of tape guide posts to the print station.

* * * * *